US008545196B2

(12) United States Patent
Krause et al.

(10) Patent No.: US 8,545,196 B2
(45) Date of Patent: Oct. 1, 2013

(54) HOSE PUMP

(75) Inventors: Bjoern Krause, Crailsheim (DE); Patrick Weinstock, Satteldorf (DE); Marc Braeuninger, Satteldorf (DE); Klaus Ullherr, Crailsheim (DE); Albert Eberhardt, Iishofen (DE); Werner Mayer, Crailsheim (DE); Michael Bratz, Crailsheim (DE)

(73) Assignee: Robert Bosch GmbH, Stuttgart (DE)

( * ) Notice: Subject to any disclaimer, the term of this patent is extended or adjusted under 35 U.S.C. 154(b) by 194 days.

(21) Appl. No.: 13/143,245

(22) PCT Filed: Dec. 3, 2009

(86) PCT No.: PCT/EP2009/066285

§ 371 (c)(1),
(2), (4) Date: Jul. 5, 2011

(87) PCT Pub. No.: WO2010/081591

PCT Pub. Date: Jul. 22, 2010

(65) Prior Publication Data

US 2011/0274562 A1 Nov. 10, 2011

(30) Foreign Application Priority Data

Jan. 19, 2009 (DE) ..... 10 2009 000 299

(51) Int. Cl.
*F04B 43/12* (2006.01)

(52) U.S. Cl.
USPC ..... 417/475; 417/477.1; 417/477.9

(58) Field of Classification Search
USPC ..... 417/474, 475, 476, 477.1, 477.2, 417/477.3, 477.4, 477.5, 477.6, 477.7, 477.8, 417/477.9, 477.11, 477.12, 477.14
See application file for complete search history.

(56) References Cited

U.S. PATENT DOCUMENTS 3,723,030 A * 3/1973 Gelfand ..... 417/475
3,876,340 A * 4/1975 Thomas ..... 417/475

(Continued)

FOREIGN PATENT DOCUMENTS

EP 0731275 9/1996
EP 1898094 3/2008

(Continued)

OTHER PUBLICATIONS

PCT/EP2009/066285 International Search Report.

*Primary Examiner* — Devon Kramer
*Assistant Examiner* — Nathan Zollinger
(74) *Attorney, Agent, or Firm* — Michael Best & Friedrich LLP

(57) ABSTRACT

A hose pump for delivering fluids includes a housing having a base body and a cover. A pump body for delivering a fluid is rotatably disposed in the interior of the base body about an axis. A locking device is disposed on the housing in order to release and lock the cover. The pump body comprises a plurality of rollers disposed at the circumference of the pump body and delivering a fluid present in a hose by rotating the pump body. The rollers clamp the hose against an inner surface of the cover, and the locking device is attached captively to the base body and displaceably relative to the base body, and can be actuated single-handedly. The cover is attached captively to the base body and displaceably relative to the base body of the housing, and can be actuated single-handedly.

27 Claims, 3 Drawing Sheets

(56) References Cited

U.S. PATENT DOCUMENTS

| | | | | | |
|---|---|---|---|---|---|
| 4,233,001 | A | * | 11/1980 | Schmid | 417/475 |
| 4,798,580 | A | * | 1/1989 | DeMeo et al. | 604/30 |
| 4,886,431 | A | * | 12/1989 | Soderquist et al. | 417/477.2 |
| 4,997,347 | A | | 3/1991 | Roos | |
| 5,443,451 | A | * | 8/1995 | Chapman et al. | 604/153 |
| 5,971,726 | A | | 10/1999 | Yoshida et al. | |
| 6,041,709 | A | * | 3/2000 | Wells et al. | 101/366 |
| 7,478,999 | B2 | | 1/2009 | Limoges | |
| 2006/0048844 | A1 | | 3/2006 | Merrill et al. | |
| 2010/0224547 | A1 | | 9/2010 | Fujii | |
| 2012/0294742 | A1 | * | 11/2012 | Reich et al. | 417/474 |

FOREIGN PATENT DOCUMENTS

| | | |
|---|---|---|
| JP | 49-70501 | 6/1974 |
| JP | 61055184 | 4/1986 |
| JP | 4-6583 | 1/1992 |
| WO | 2004048779 | 6/2004 |

* cited by examiner

HOSE PUMP

BACKGROUND OF THE INVENTION

The present invention relates to a hose pump which is used for delivering fluids, in particular in filling processes in an insulator, in which the operation has to be carried out externally, as well as an insulator comprising such a hose pump.

In hose pumps used in insulated filling machines the installation and operating steps of the hose pumps arranged therein have to take place through glove access points, with the resulting restricted mobility and dexterity. In hose pumps used hitherto, however, single-handed operation is not possible, such as for example for installation and for replacing hoses and connections, and when loose components are used, the risk of such parts dropping down in the insulator occurs. This could result in an increase in the set-up time and, in the worst case, stoppage of the continuous filling processes, if the component which has dropped down is only able to be reached again by opening the insulator.

SUMMARY OF THE INVENTION

The hose pump according to the invention has, however, the advantage that in this case the operating and/or handling steps on the components of the hose pump to be moved, the cover and the locking device, may be carried out single-handedly using the glove access point in the insulator. Moreover, the cover and the locking device of the hose pump are fastened movably and captively to the housing, so that said parts are prevented from dropping down in the insulator. By their correspondingly large size and shape, said parts may be easily gripped and actuated via the glove access point(s) used.

It is further preferred if the cover of the hose pump according to the invention is fastened to the housing in a pivotable manner about a first axis. As a result, the cover of the housing may be easily opened and in a manner which does not hinder the insertion of the hose. Additionally, the locking device of the hose pump according to the invention is preferably fastened to the housing in a pivotable manner about a second axis, whereby it is ensured that the cover is unlocked and/or locked in a compact and functionally reliable manner.

Preferably, the housing is of cylindrical configuration and the cover in the opened state opens up a circumferential region of substantially 180° of the pump body located therein. As a result, the single-handed insertion of the hose into the pump body is substantially facilitated.

According to a further preferred embodiment of the invention, the hose pump comprises two coaxially arranged pump bodies in the housing. As a result, the fluid may be delivered more uniformly compared to a single pump body.

Preferably, fluid is supplied to the two pump bodies via a branch hose with a double hose portion. As a result, the volumetric flow of the fluid is distributed uniformly and cost-effectively to both pump bodies and the pump bodies may be driven by a common drive.

Further preferably, two outwardly protruding fastening elements, in particular pins, are arranged on the housing in order to clamp the branch hose at the respective forks to the fastening elements. As a result, the branch hose may be mounted single-handedly in a simple manner and dismantled again and fits securely during operation.

According to a further preferred embodiment of the invention, the locking device comprises a pivotable lever which is bent in the longitudinal direction and comprises an outwardly cranked end region relative to the housing. This shape facilitates the pivoting and locking and/or unlocking of the cover when using the glove with single-handed operation.

Preferably, for pivoting the locking device, the second axis is arranged perpendicular to the first axis for opening the cover. As a result, a maximum resulting locking force may be produced between the cover and locking device.

Further preferably, three rollers are arranged at intervals of 120° on the circumference of the pump body. As a result, a sufficient delivery rate is achieved with a minimum number of components and reduced costs.

Moreover, the invention relates to an insulator comprising a hose pump according to the invention, in particular for filling pharmaceutical products or other toxic materials.

Preferably, the insulator used together with the hose pump according to the invention may comprise just one glove access point. As a result, a simplified construction and a reduction in the manufacturing costs of the insulator may be achieved.

It should be noted that, in principle, by means of the hose pump according to the invention, single-phase or multi-phase fluids, mixtures consisting of fluids and gases, mixtures consisting of fluids and solids and pasty fluids may be delivered, which substantially have a viscosity range as in conventionally used hose pumps.

BRIEF DESCRIPTION OF THE DRAWINGS

Exemplary embodiments of the invention are described hereinafter in detail with reference to the accompanying drawing, in which.

DETAILED DESCRIPTION

Figure 1:
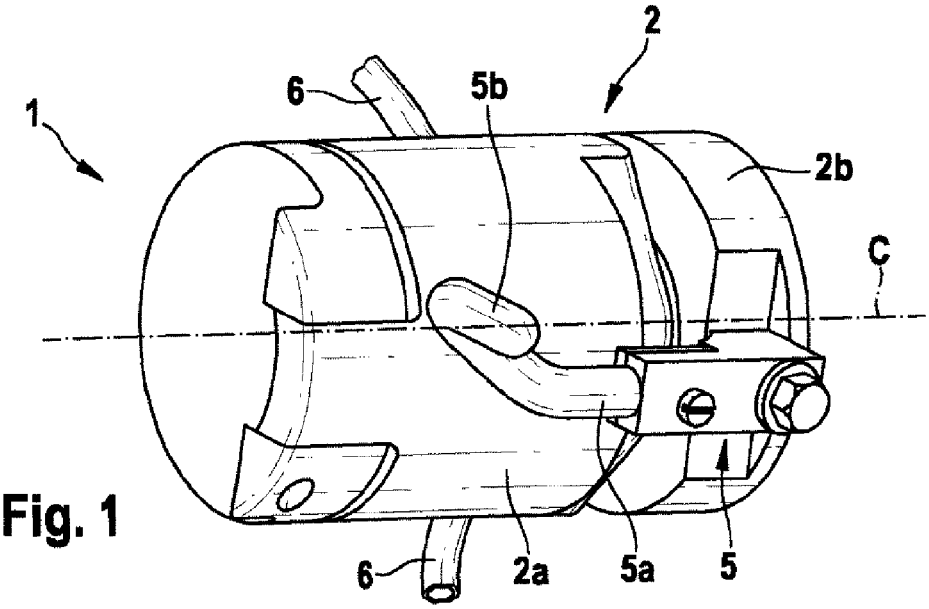
FIG. 1 is an enlarged perspective view of a first exemplary embodiment of the hose pump according to the invention.
Figure 2:
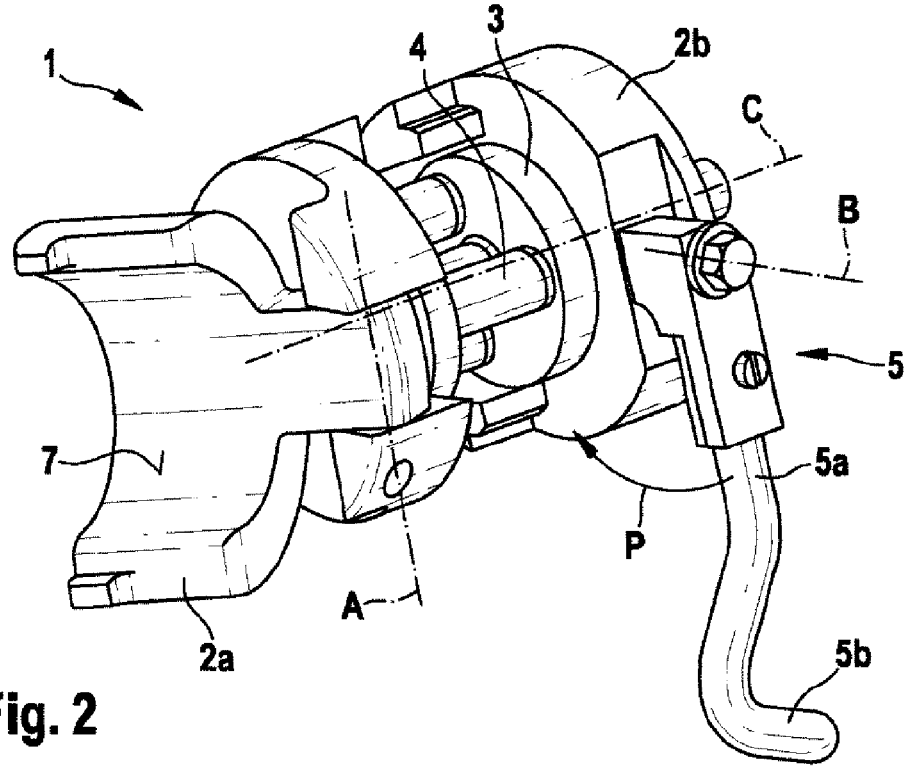
FIG. 2 is an enlarged perspective view of the hose pump of FIG. 1 in the opened state.

With reference to FIGS. 1 and 2, a hose pump according to a first preferred exemplary embodiment of the invention is described hereinafter in detail.

As is visible from the enlarged perspective view of an exemplary embodiment of the hose pump 1 according to the invention of FIG. 1, the hose pump comprises a cylindrical housing 2 with a base body 2*b* and a cover 2*a* for opening the housing.

For unlocking and/or locking the cover 2*a* which may be pivoted about a first axis A, a locking device 5 is arranged on the housing 2. The locking device 5 which may be seen in FIG. 1 in the locked position and in FIG. 2 in the unlocked position, is movable relative to the base body 2*b* of the housing 2 and fastened captively to the base body 2*b*. The locking device 5 has a lever 5*a* which may be pivoted about a second axis B, and which, in the closed state of the hose pump shown in FIG. 1, extends parallel to a third axis C in the longitudinal direction of the housing 2, and is of bent configuration and comprises an outwardly cranked end region 5*b* relative to the housing 2. By this shape of the lever 5*a*, the gripping and actuation of the locking device 5, in particular through the glove access point required in insulated filling machines, may be carried out exceptionally easily and with one hand.

Similarly, the cover 2*a*, as is visible from FIG. 2, is movable relative to the base body 2*b* of the housing 2 and fastened captively to the base body 2*b*, and may thus be pivoted single-handedly about the first axis A.

As is visible from the perspective view of the hose pump shown in FIG. 2 in the open state, a pump body 3 which is rotatable about the third axis C is further arranged in the inside of the base body 2*b* of the housing 2 for delivering a fluid. Said pump body 3 has a plurality of rollers 4 arranged on its circumference, onto which a hose 6 is positioned without fixing being required. If the cover 2*a* fastened pivotably about the first axis A is closed and is locked by pivoting the locking device 5 in the direction of an arrow P, the inner surface 7 of the cover 2*a* presses the hose 6 onto the rollers 4. When the pump body 3 rotates, the circulating rollers 4 thus partially clamp the hose 6 and, as a result, deliver the fluid. When unlocking the cover 2*a* by pivoting the locking device 5 counter to the direction of the arrow P, the cover 2*a* is forced outwards by the pressure of the fluid which is still present in the hose 6 and in the best case may completely pivot about the first axis A outwardly to a position as shown in FIG. 2. As a result of the cover 2*a* fastened captively to the base body 2*b*, and the locking device 5 fastened captively to the base body 2*b*, the hose pump according to the invention advantageously has no loose components which may drop down in the inside of the insulator. Preferably, for pivoting the locking device 5, the second axis B is arranged perpendicular to the third axis C of the hose pump and, for pivoting the cover 2*a*, the first axis A is again arranged perpendicular to the second axis B of the locking device 5, in order to achieve a construction of the hose pump which is compact and able to be easily mounted.

Figure 3:
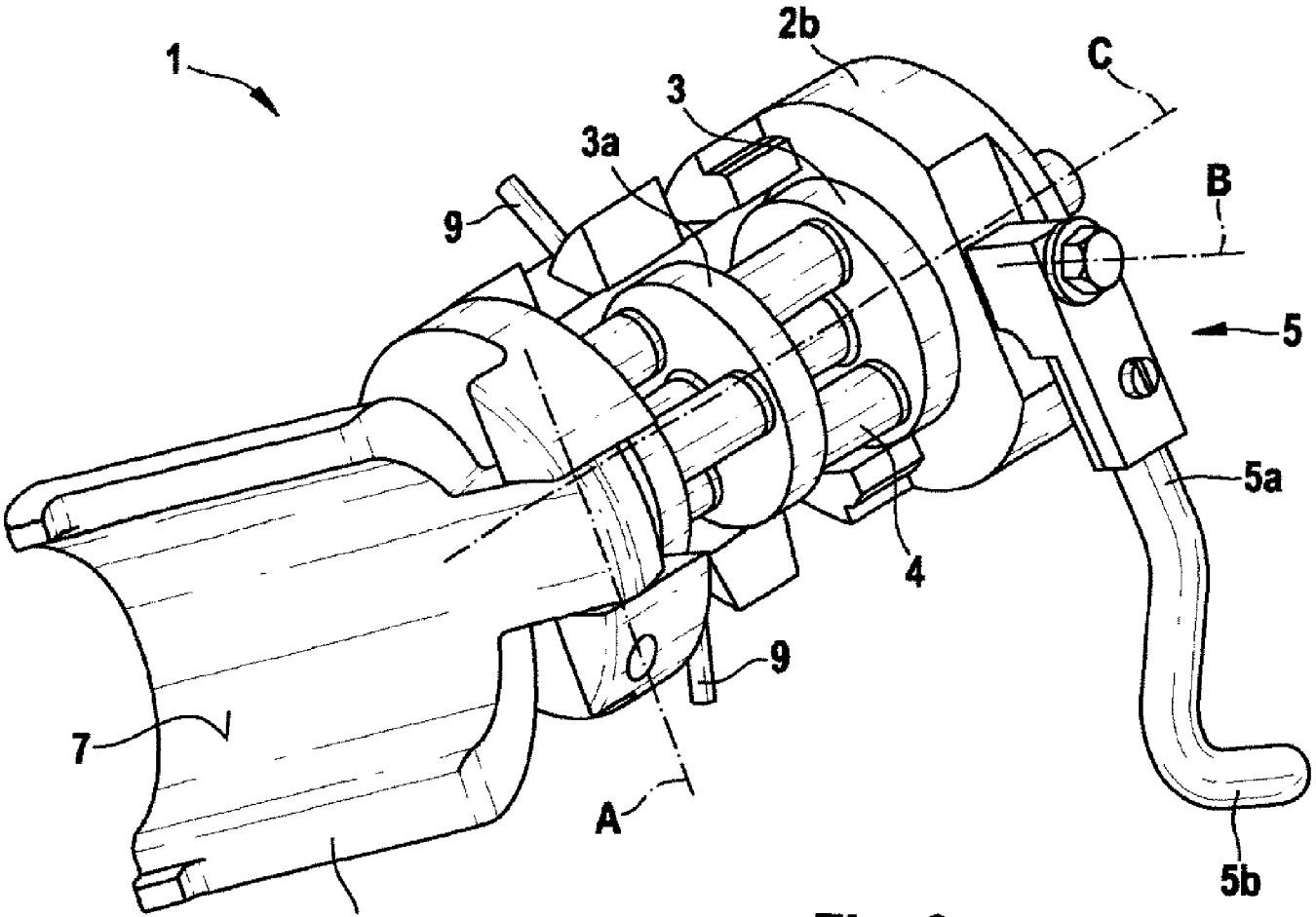
FIG. 3 is an enlarged perspective view of a second exemplary embodiment of the hose pump according to the invention.
Figure 4:
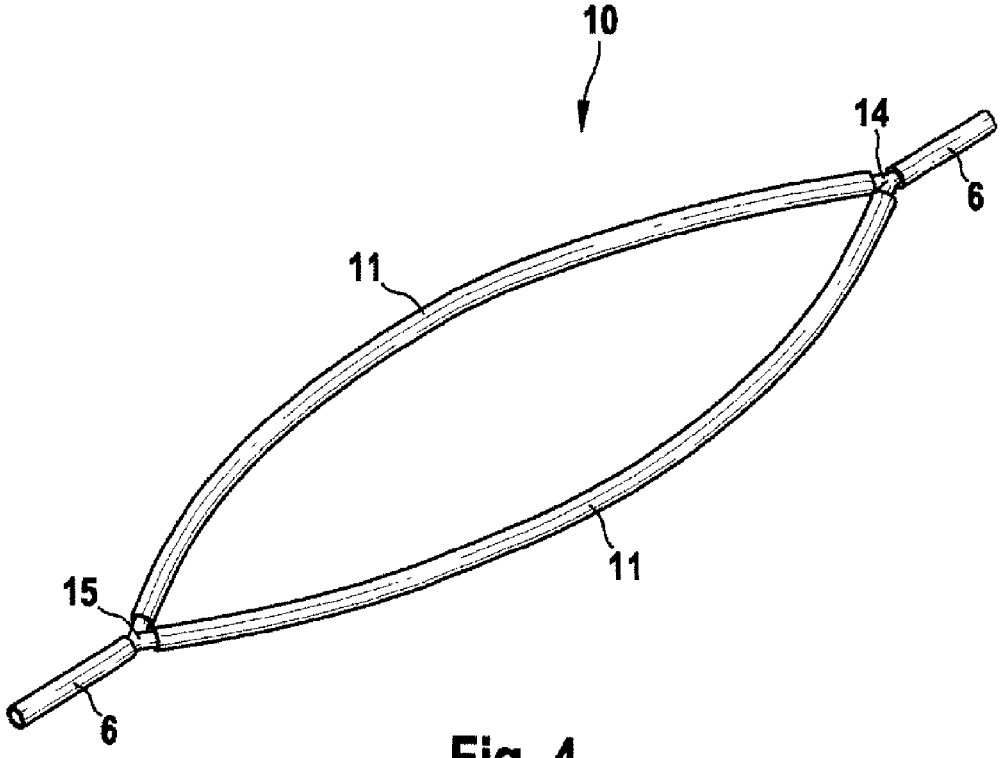
FIG. 4 is a schematic view of the branch hose used in the hose pump of FIG. 3.

In FIGS. 3 and 4, a hose pump 1 according to a second exemplary embodiment of the present invention is now disclosed below. Components which are the same and/or functionally the same are described here using the same reference numerals as in the first exemplary embodiment.

FIG. 3 shows the hose pump 1 according to the second exemplary embodiment in an enlarged perspective view in the opened state. In contrast to the first exemplary embodiment shown in FIGS. 1 and 2, the second exemplary embodiment has two coaxially arranged pump bodies 3, 3*a* in the base body 2*b*. Fluid is supplied to the two pump bodies 3, 3*a* via a branch hose 10 shown in FIG. 4, which has a double hose portion 11. As shown in FIG. 4, the double hose portion 11 in each case branches off from the single portion of the hose 6 at forks 14 and 15, so that identical volumetric flows are delivered in both branches of the double hose portion 11 during operation of the hose pump.

Two pins 9 protruding from the base body 2*b* are arranged on the outside of the base body 2*b* of the housing 2, as visible in FIG. 3. The hose 6 is suspended at its first fork 14 on one of these pins 9 and subsequently the double hose portion 11 is pulled over the pump body 3, 3*a*, and the hose 6 at its second fork 15 is suspended and/or clamped on the other pin 9. This process is able to be carried out single-handedly in a simple manner with the glove which is used, as in the case of the single hose of the first exemplary embodiment and, as a result, has a clear advantage relative to mounting the hose in conventional hose pumps in an insulator, used at the present time, which has to be carried out using both hands in the glove access point. In other respects, this exemplary embodiment corresponds to the first exemplary embodiment, so that reference may be made to the description provided there.

The invention claimed is:

1. A hose pump, comprising:

a housing (2) with a base body (2*b*) and a cover (2*a*) for opening the housing;

a pump body (3) for delivering fluid, the pump body (3) arranged in the inside of the base body (2*b*) of the housing (2) in a rotatable manner about an axis (C); and a locking device (5) arranged on the housing (2) in order to release and to lock the cover (2*a*), the pump body (3) comprising a plurality of rollers (4) arranged on a circumference of the pump body (3), and which deliver fluid located in a hose (6) by rotating the pump body (3), the rollers (4) clamping the hose (6) against an inner surface (7) of the cover (2*a*);

the locking device (5) being movable relative to the base body (2*b*) of the housing (2) and captively fastened to the base body (2*b*) and able to be actuated single-handedly, and the cover (2*a*) being movable relative to the base body (2*b*) of the housing (2) and being captively fastened to the base body (2*b*) and able to be actuated single-handedly, characterized in that the pump body (3) is a first pump body, and the hose pump further comprises a second pump body (3*a*) coaxial with the first pump body (3) in the housing (2), fluid is supplied to the first and second pump bodies (3, 3*a*) via the hose (6) taking the form of a branch hose (10) with a double hose portion (11) and two outwardly protruding fastening elements are further arranged on the housing (2), in order to clamp single-handedly the branch hose (10) at respective forks (14, 15) to the fastening elements.

2. The hose pump as claimed in claim 1, the cover (2*a*) being fastened to the housing (2) in a pivotable manner about an axis (A).

3. The hose pump as claimed in claim 1, the locking device (5) being fastened to the housing (2) in a pivotable manner about an axis (B).

4. The hose pump as claimed in claim 1, characterized in that the housing (2) is of cylindrical configuration and the cover (2*a*) in an opened state exposes a circumferential region of substantially 180° of the base body (2*b*) of the housing (2) and of the pump bodies (3, 3*a*) located therein.

5. The hose pump as claimed in claim 1, characterized in that the locking device (5) comprises a pivotable lever (5*a*), the lever (5*a*) being bent in the longitudinal direction and comprising an outwardly cranked end region (5*b*) relative to the housing (2).

6. The hose pump as claimed in claim 1, characterized in that three rollers (4) are arranged at intervals of 120° in each case on the circumference of the pump body (3).

7. The hose pump as claimed in claim 2, the locking device (5) being arranged fastened to the housing (2) in a pivotable manner about an axis (B).

8. The hose pump as claimed in claim 7, characterized in that, for pivoting the locking device (5), the axis (B) is arranged perpendicular to the axis (A) for opening the cover (2*a*).

9. The hose pump as claimed in claim 1, characterized in that the fastening elements are pins (9).

10. The hose pump as claimed in claim 1, characterized in that the locking device (5) comprises a pivotable lever (5*a*), the lever (5*a*) being bent in the longitudinal direction and comprising an outwardly cranked end region (5*b*) relative to the housing (2).

11. A hose pump, comprising:

a housing (2) with a base body (2*b*) and a cover (2*a*) for opening the housing;

a pump body (3) for delivering fluid, the pump body (3) arranged in the inside of the base body (2*b*) of the housing (2) in a rotatable manner about an axis (C); and a locking device (5) arranged on the housing (2) in order to release and to lock the cover (2*a*), the pump body (3) comprising a plurality of rollers (4) arranged on a circumference of the pump body (3), and which deliver fluid located in a hose (6) by rotating the pump body (3), the rollers (4) clamping the hose (6) against an inner surface (7) of the cover (2*a*);

the locking device (5) being movable relative to the base body (2*b*) of the housing (2) and captively fastened to the base body (2*b*) and able to be actuated single-handedly, and the cover (2*a*) being movable relative to the base body (2*b*) of the housing (2) and being captively fastened to the base body (2*b*) and able to be actuated single-handedly, characterized in that the pump body (3) is a first pump body, and the hose pump further comprises a second pump body (3*a*) coaxial with the first pump body (3) in the housing (2), fluid is supplied to the first and second pump bodies (3, 3*a*) via the hose (6) taking the form of a branch hose (10) with a double hose portion (11) and the housing (2) is of cylindrical configuration and the cover (2*a*) in an opened state exposes a circumferential region of substantially 180° of the base body (2*b*) of the housing (2) and of the pump bodies (3, 3*a*) located therein.

12. The hose pump as claimed in claim 11, the cover (2*a*) being fastened to the housing (2) in a pivotable manner about an axis (A).

13. The hose pump as claimed in claim 11, the locking device (5) being fastened to the housing (2) in a pivotable manner about an axis (B).

14. The hose pump as claimed in claim 11, characterized in that two outwardly protruding fastening elements are further arranged on the housing (2), in order to clamp single-handedly the branch hose (10) at respective forks (14, 15) to the fastening elements.

15. The hose pump as claimed in claim 14, characterized in that the fastening elements are pins (9).

16. The hose pump as claimed in claim 14, characterized in that the locking device (5) comprises a pivotable lever (5*a*), the lever (5*a*) being bent in the longitudinal direction and comprising an outwardly cranked end region (5*b*) relative to the housing (2).

17. The hose pump as claimed in claim 11, characterized in that the locking device (5) comprises a pivotable lever (5*a*), the lever (5*a*) being bent in the longitudinal direction and comprising an outwardly cranked end region (5*b*) relative to the housing (2).

18. The hose pump as claimed in claim 11, characterized in that three rollers (4) are arranged at intervals of 120° in each case on the circumference of the pump body (3).

19. The hose pump as claimed in claim 12, the locking device (5) being arranged fastened to the housing (2) in a pivotable manner about an axis (B).

20. The hose pump as claimed in claim 19, characterized in that, for pivoting the locking device (5), the axis (B) is arranged perpendicular to the axis (A) for opening the cover (2*a*).

21. A hose pump, comprising:

a housing (2) with a base body (2*b*) and a cover (2*a*) for opening the housing;

a pump body (3) for delivering fluid, the pump body (3) arranged in the inside of the base body (2*b*) of the housing (2) in a rotatable manner about an axis (C); and a locking device (5) arranged on the housing (2) in order to release and to lock the cover (2*a*), the pump body (3) comprising a plurality of rollers (4) arranged on a circumference of the pump body (3), and which deliver fluid located in a hose (6) by rotating the pump body (3), the rollers (4) clamping the hose (6) against an inner surface (7) of the cover (2*a*);

the locking device (5) being movable relative to the base body (2*b*) of the housing (2) and captively fastened to the base body (2*b*) and able to be actuated single-handedly, and the cover (2*a*) being movable relative to the base body (2*b*) of the housing (2) and being captively fastened to the base body (2*b*) and able to be actuated single-handedly, characterized in that the pump body (3) is a first pump body, and the hose pump further comprises a second pump body (3*a*) coaxial with the first pump body (3) in the housing (2), fluid is supplied to the first and second pump bodies (3, 3*a*) via the hose (6) taking the form of a branch hose (10) with a double hose portion (11), the cover (2*a*) being fastened to the housing (2) in a pivotable manner about an axis (A), and the locking device (5) being arranged fastened to the housing (2) in a pivotable manner about an axis (B) and for pivoting the locking device (5), the axis (B) is arranged perpendicular to the axis (A) for opening the cover (2*a*).

22. The hose pump as claimed in claim 21, characterized in that the housing (2) is of cylindrical configuration and the cover (2*a*) in an opened state exposes a circumferential region of substantially 180° of the base body (2*b*) of the housing (2) and of the pump bodies (3, 3*a*) located therein.

23. The hose pump as claimed in claim 21, characterized in that the locking device (5) comprises a pivotable lever (5*a*), the lever (5*a*) being bent in the longitudinal direction and comprising an outwardly cranked end region (5*b*) relative to the housing (2).

24. The hose pump as claimed in claim 21, characterized in that three rollers (4) are arranged at intervals of 120° in each case on the circumference of the pump body (3).

25. The hose pump as claimed in claim 21, characterized in that two outwardly protruding fastening elements are further arranged on the housing (2), in order to clamp single-handedly the branch hose (10) at respective forks (14, 15) to the fastening elements.

26. The hose pump as claimed in claim 25, characterized in that the fastening elements are pins (9).

27. The hose pump as claimed in claim 25, characterized in that the locking device (5) comprises a pivotable lever (5*a*), the lever (5*a*) being bent in the longitudinal direction and comprising an outwardly cranked end region (5*b*) relative to the housing (2).

* * * * *